US007007940B2

(12) United States Patent
Polidoro et al.

(10) Patent No.: US 7,007,940 B2
(45) Date of Patent: Mar. 7, 2006

(54) BANKNOTE STORE

(75) Inventors: Roberto Polidoro, Geneva (CH); Guillermo Garcia, Geneva (CH)

(73) Assignee: Mars, Incorporated, McLean, VA (US)

( * ) Notice: Subject to any disclaimer, the term of this patent is extended or adjusted under 35 U.S.C. 154(b) by 168 days.

(21) Appl. No.: 10/115,153

(22) Filed: Apr. 3, 2002

(65) Prior Publication Data

US 2002/0145248 A1 Oct. 10, 2002

(30) Foreign Application Priority Data

Apr. 3, 2001 (EP) ..... 01303174

(51) Int. Cl.
*B65H 5/22* (2006.01)

(52) U.S. Cl. ..... 271/3.11; 271/11; 271/196; 271/197

(58) Field of Classification Search ..... 271/3.01, 271/3.08, 3.11, 11, 12, 94, 30.1, 177, 196, 271/197, 207; 414/933
See application file for complete search history.

(56) References Cited

U.S. PATENT DOCUMENTS

| | | | | |
|---|---|---|---|---|
| 3,395,915 A * | 8/1968 | Clausen et al. | ..... | 271/197 |
| 3,820,779 A * | 6/1974 | Bishop | ..... | 271/180 |
| 3,941,374 A * | 3/1976 | Vits | ..... | 271/183 |
| 4,643,412 A * | 2/1987 | Heina et al. | ..... | 271/94 |
| 4,824,092 A * | 4/1989 | Kriefall et al. | ..... | 271/183 |
| 5,022,641 A * | 6/1991 | Okada | ..... | 271/3.08 |
| 5,116,037 A | 5/1992 | Gerlier et al. | | |
| 5,671,920 A * | 9/1997 | Acquaviva et al. | ..... | 271/307 |
| 5,915,683 A * | 6/1999 | Otsuka | ..... | 271/94 |
| 6,082,728 A * | 7/2000 | Ubayashi | ..... | 271/108 |
| 6,443,442 B1 * | 9/2002 | Willis et al. | ..... | 271/11 |

FOREIGN PATENT DOCUMENTS

| | | | |
|---|---|---|---|
| DE | 1 933 077 | | 1/1971 |
| DE | 4231891 A1 | * | 3/1994 |
| EP | 0 812 790 A1 | | 12/1997 |
| GB | 2 041 887 A | | 9/1980 |
| JP | 54-122569 A | * | 9/1979 |
| JP | 60-232362 A | * | 11/1985 |

* cited by examiner

*Primary Examiner*—David H. Bollinger
(74) *Attorney, Agent, or Firm*—Fish & Richarson P.C.

(57) ABSTRACT

A banknote store can remove banknotes individually from a stack by light air pressure extending over a substantial area of the banknote, the banknote then being transportable without needing to move the source of the reduced pressure. Banknotes are added individually by using reduced pressure to hold them against a transport belt before they are deposited on the stack.

14 Claims, 12 Drawing Sheets

BANKNOTE STORE

This invention relates to the storage of banknotes or other sheets of value, which are herein referred to simply as banknotes or bills.

There have been proposed numerous types of banknote stores. Some enable dispensing of banknotes, for example in automatic cash dispensing machines. Others allow the addition of banknotes to the store, for example in vending machines. It is however not very common to have storage means which can both receive and dispense individual banknotes, because the mechanisms used hereto for achieving this have been unreliable, expensive, complicated and/or large, which has meant that the mechanisms have been unsuitable especially for use in vending applications.

Adding banknotes to the stack is often achieved by a transport mechanism which moves the banknote to a position above the stack, and a piston which shifts the banknote from the transport mechanism to the stack. This requires a lot of space. The various techniques used for achieving dispensing of individual banknotes have included the application of friction, for example to cause a buckling configuration of the uppermost banknote to enable it to be stripped from the stack. It is also known to remove banknotes by the use of suction. For example, a suction pump is connected via a conduit to an outlet on the periphery of a roller and a banknote is gripped and held on the roller by the strong suction force. Rotation of the roller then strips the banknote from a stack. This however can be quite complicated to construct, and is subject to reliability problems if there are holes in the banknotes.

Some aspects of the present invention relate to techniques for enabling banknotes to be individually dispensed from a store. Other aspects relate to techniques for individually adding banknotes to a store. Preferably, these aspects are combined in a banknote store which can both receive banknotes individually and dispense them individually. However, the invention is also applicable to stores which have a pre-formed stack therein, from which banknotes can be individually dispensed, and stores which can receive banknotes individually but which either cannot dispense banknotes or can only dispense them as a bundle.

Aspects of the present invention are set out in the accompanying claims.

According to a further aspect, banknotes are moved from a stack by the application of relatively low-strength suction over a relatively large area. This means that small holes in the banknote will not influence the operation. Also, because the forces involved are relatively low, a separate transport means can be used for conveying the banknote laterally away from the stack without the requirement for moving the reduced-pressure area.

Conversely, and according to a further aspect of the invention, a banknote can be laterally moved to a position in which it is suspended above a stack by a relatively low-force suction applied over a relatively large area, thus enabling the banknote to be deposited on the stack when the source of the reduced pressure is deactivated.

In each of these aspects, preferably, the area over which the reduced pressure is applied can be varied. Thus, the area can be progressively reduced as a banknote is transported away from the stack, so that the remaining bills in the stack are not subject to a significant amount of reduced pressure. For similar reasons, the amount of area over which the reduced pressure is applied can be increased as a banknote is moved over the stack.

Arrangements embodying the invention will now be described by way of example with reference to the accompanying drawings which are schematic views of the various embodiments in which like reference numbers represent like integers, and in which.

Figure 1:
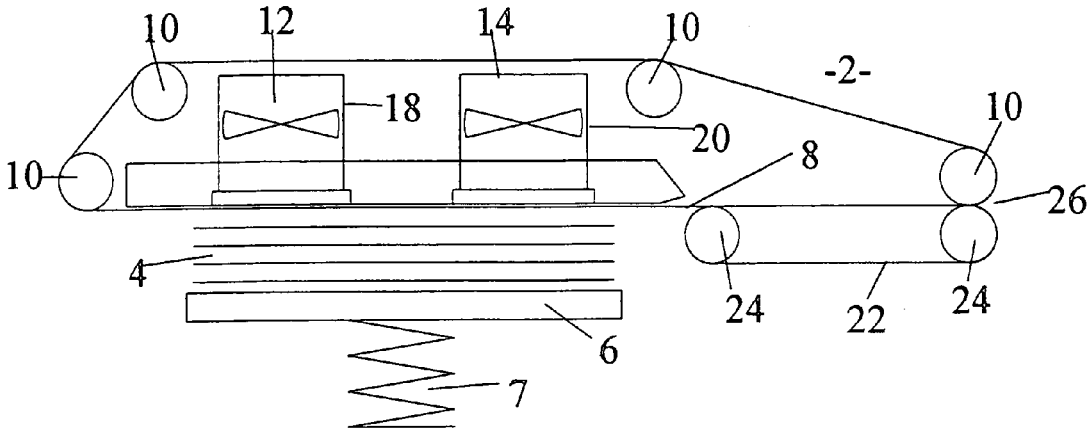
FIG. 1 shows a banknote store according to a first embodiment.

Referring to FIG. 1, the banknote store 2 is operable to store a stack 4 of banknotes which are supported by a platform 6 biassed upwardly by a spring 7. The platform 6 pushes the stack so that the uppermost bill is pressed against a belt 8 which has a high coefficient of friction and which extends around rollers 10. Two fans, 12, 14, are disposed above the belt 8 and are positioned so that they cause air to flow upwardly through the fan housings 18, 20. The housings 18, 20 thus constitute conduits or air conveying means which convey air away from the banknote stack 4 and thus produce a low pressure over a substantial area.

Each of the fans 12, 14 can comprise a cooling fan of the type commonly used in personal computers. Such fans are compact, inexpensive and readily available.

Another belt 22 extends around rollers 24 and is operable to convey banknotes individually between the stack and an inlet/outlet 26.

Details of the operation of the store 2 will become apparent from the following description. In brief, to extract a banknote from the top of the stack, the fans 12 and 14 are energised so as to retain the topmost banknote up against the belt 8, the platform 6 and the supported stack 4 are moved downwards, and the belts 8 and 22 are driven so as to convey the banknote to the inlet/outlet 26.

In order to add a banknote to the stack, the platform 6 and the stack 4 are moved downwardly, the new banknote is fed from the inlet/outlet 26 by means of the belts 8 and 22 to a location beneath the fans 12 and 14, the fans 12 and 14 being energised so as to suspend the banknote over the stack 4, and the platform 6 and stack 4 are raised and the fans 12 and 14 de-energised.

Figure 2:
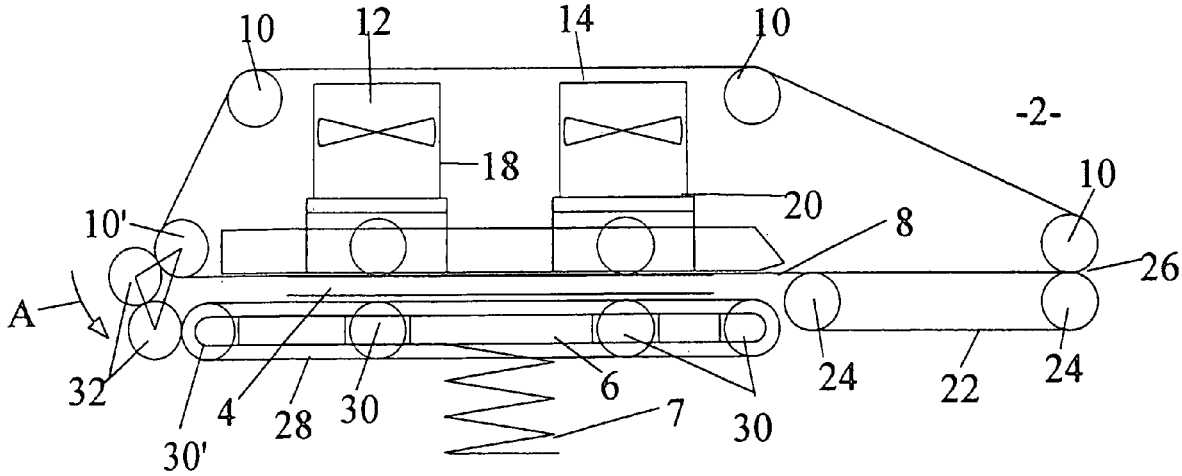
FIG. 2 shows a banknote escrow store according to a second embodiment.

Referring to FIG. 2, this shows a second embodiment which is similar to the embodiment of FIG. 1, except that, in this embodiment, which constitutes an escrow store, the entire stack 4 of banknotes can be removed as a bundle. For this purpose, the platform 6 is provided with a further transport mechanism formed by a belt 28 and rollers 30. Banknotes can be individually added to and removed from the stack 4, as in the embodiment of FIG. 1. However, additionally, by simultaneously driving the belts 8, 22 and 28, the entire stack can be conveyed to the inlet/outlet 26.

One of the rollers 10' can drive, via idle rollers 32, the belt 28 where it extends around one of the rollers 30' so as to synchronise the movement of the belts 8 and 28. The roller 10' and the rollers 32 are mounted on a common support structure which is pivotable about the axis of the roller 10' and biassed in the direction of arrow A, so that the belt 28 and the roller 30' are drivingly engaged irrespective of their rest positions, which are determined by the thickness of the stack 4.

Figure 3:
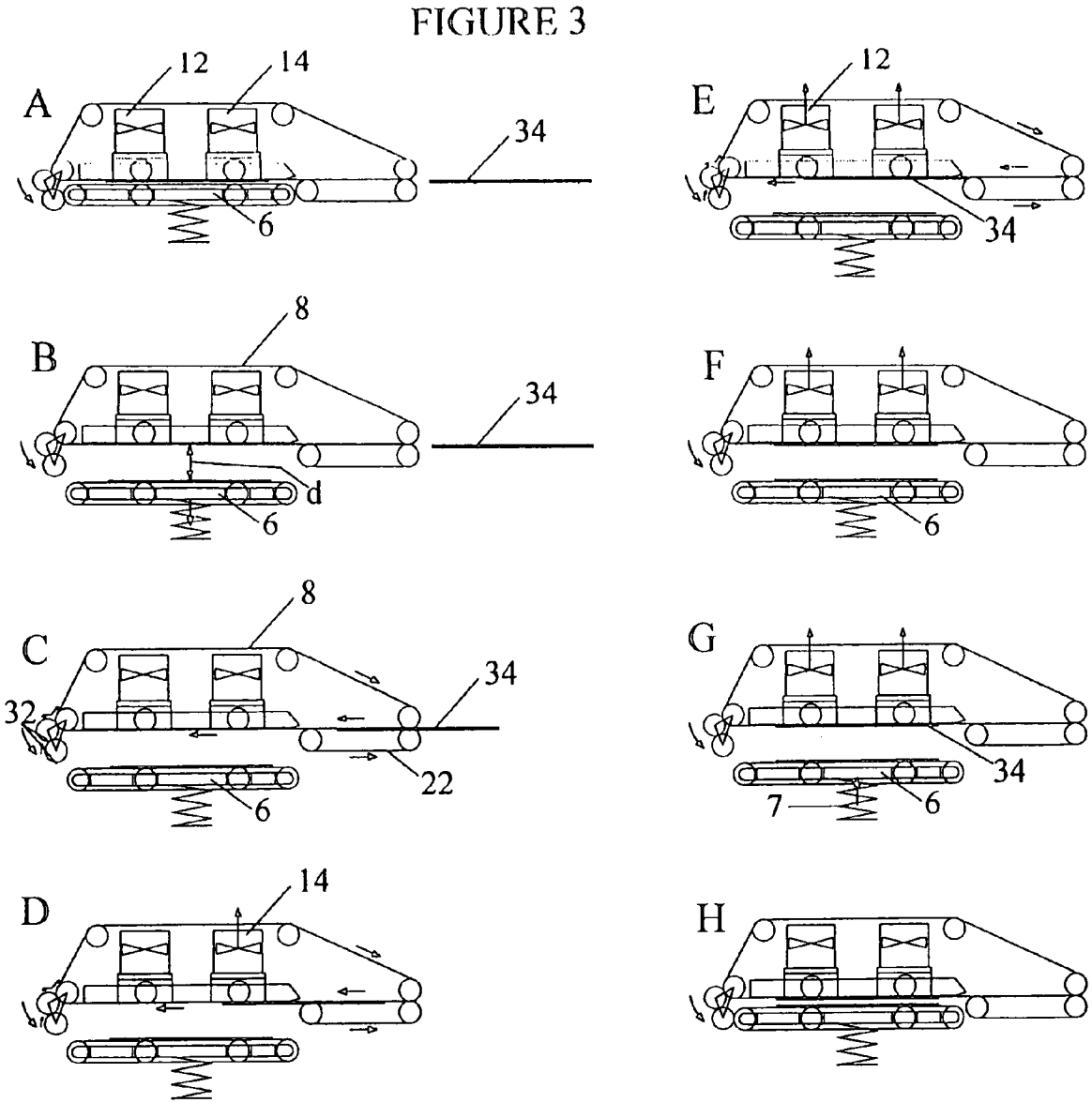
FIGS. 3A to 3H are views showing successive stages of operation of the escrow store of FIG. 2 when a new banknote is added to the store.
Figure 4:
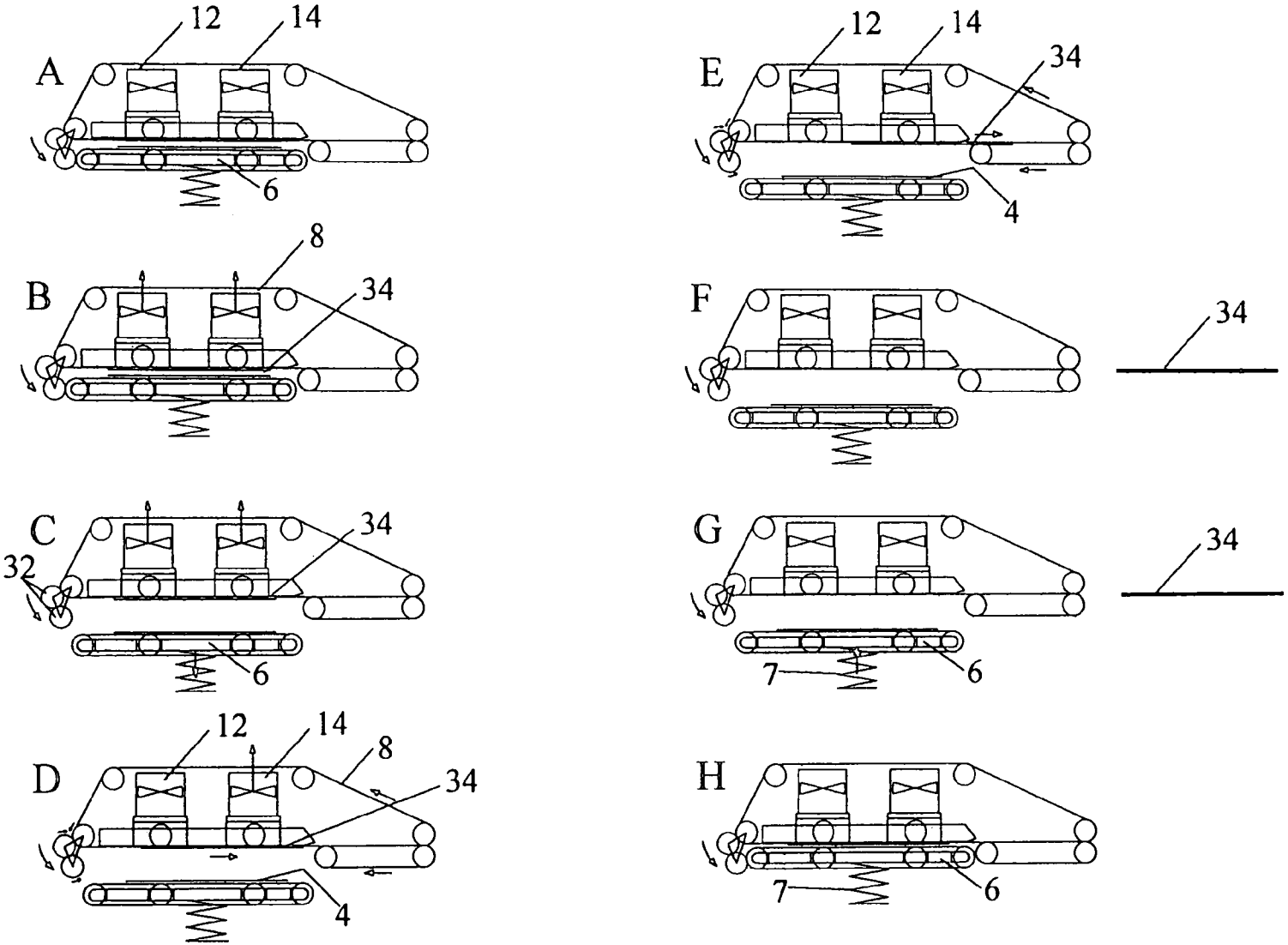
FIGS. 4A to 4H show successive stages of operation of the escrow store when a banknote is removed from the store.

The insertion and extraction of individual banknotes from the store of the embodiment of FIG. 2 will now be described in detail with reference to FIGS. 3 and 4. The store of the embodiment of FIG. 1 would operate in a corresponding manner.

FIG. 3A shows the store 2 in a state it adopts before a new banknote 34 is added. The operation begins by forcing the platform 6, and thus the supported stack 4, to move downwardly (FIG. 3B). Preferably, the platform is moved downwardly by a predetermined distance, irrespective of its starting position, which will be dependent upon the thickness of the stack 4. As a result, there will be a predetermined distance d separating the uppermost banknote from the belt 8.

Then, as shown in FIG. 3C, the belts 8 and 22 are driven in the directions of the proximate arrows so as to convey the banknote 34 from the inlet towards the lateral position of the stack.

Referring to FIG. 3D, as the leading end of the banknote 34 passes underneath the fan 14, the fan is energised so as to suspend this part of the banknote above the stack and against the belt 8.

As shown in FIG. 3E, the fan 12 is energised as the leading end of the banknote 34 reaches the area underneath it, and thus when the banknote is laterally aligned with the stack 4, as shown in FIG. 3F, both fans 12 and 14 are holding the banknote suspended against the belt 8.

The platform 6 is then released so that it can move upwardly under the force of the biassing means 7 (FIG. 3G), and after the platform has moved upwardly the energisation of the fans 12 and 14 is terminated (FIG. 3H) so that the stack now has a new banknote 34 on the top.

It will be noted that, while the platform 6 is in its lower position (FIG. 3C), it is no longer engaged by the idling rollers 32 so that the driving movement of the belt 8 is not transmitted to the platform belt 28.

FIG. 4A shows the store 2 in its initial state prior to the removal of the uppermost banknote 34. At FIG. 4B, the fans 12 and 14 are energised so as to cause the banknote 34 to be held against the belt 8.

Then, at FIG. 4C, the platform 6 is caused to moved downwardly by a predetermined distance, the banknote 34 being retained in its initial position.

At step 4D, the belts 8 and 22 are driven in the direction of the arrows so that the banknote is conveyed towards the inlet/outlet 26. During this movement, as shown in FIGS. 4D and 4E, the fans 12 and 14 are switched off in succession so that no, or little, suction is applied to the remainder of the stack 4.

After the banknote 34 has been removed (FIG. 4F), the platform 6 is released (FIG. 4G) and thus the stack is moved back upwardly into its initial position (FIG. 4H).

Figure 5:
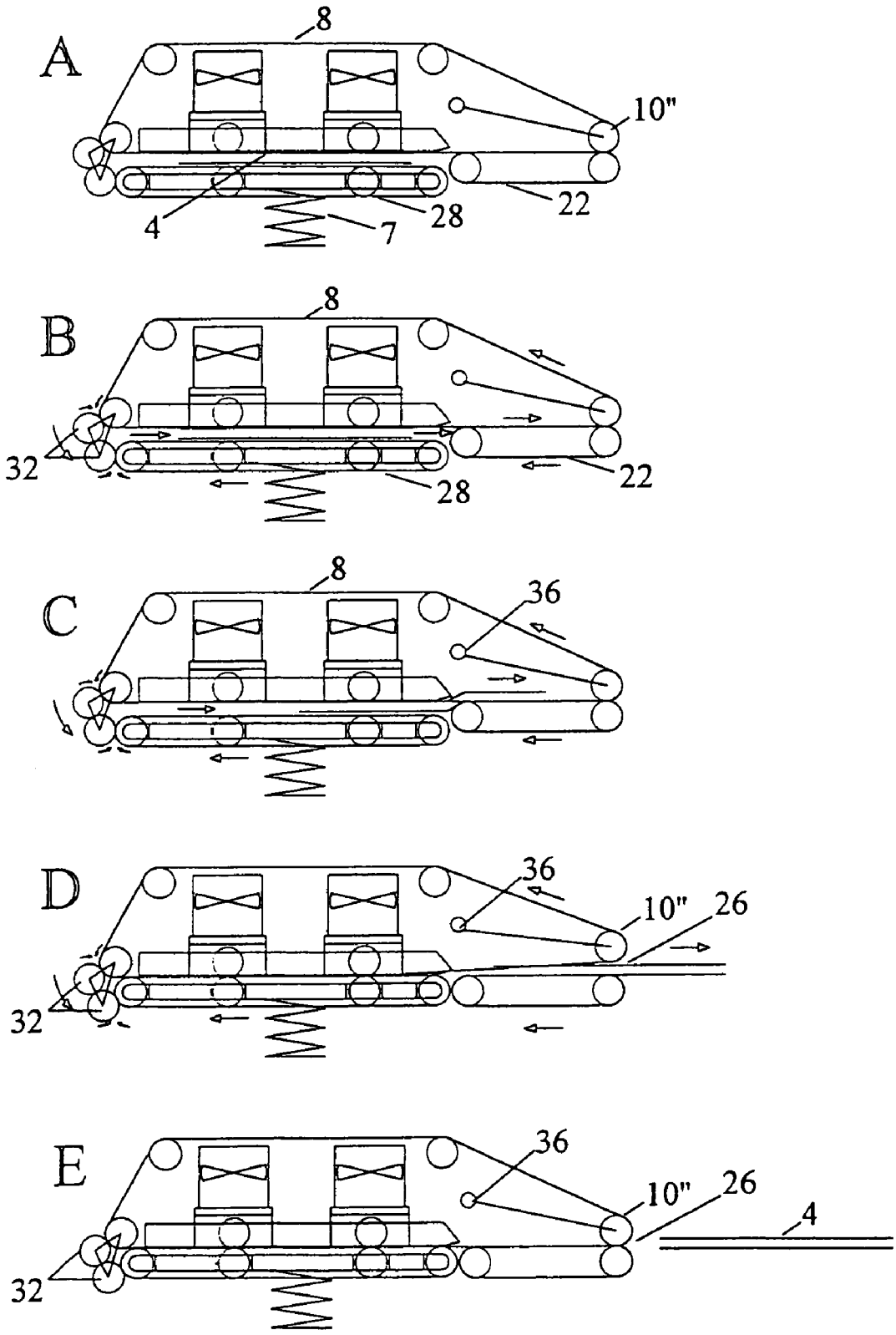
FIGS. 5A to 5E show successive stages of operation when the stack is removed from the escrow store as a bundle.

FIG. 5A shows the store 2 immediately before the stack 4 is dispensed as a bundle. At FIG. 5B, the belts 8 and 22 are driven in the direction of the proximate arrows, thus causing the belt 28 also to be driven by the idle rollers 32. Thus, the entire stack is moved to the right as shown in the drawings until it is gripped between the belts 8 and 22 and then transported to and out of the inlet/outlet 26 (FIGS. 5D and 5E). One of the rollers 10" may be movable against a bias so as to allow more room to accommodate the stack 4 between the belts 8 and 22. For example, the roller 10" may be mounted on a structure which is pivoted about an axis 36, the structure (not shown) being biassed in a clockwise direction about the axis.

Figure 6:
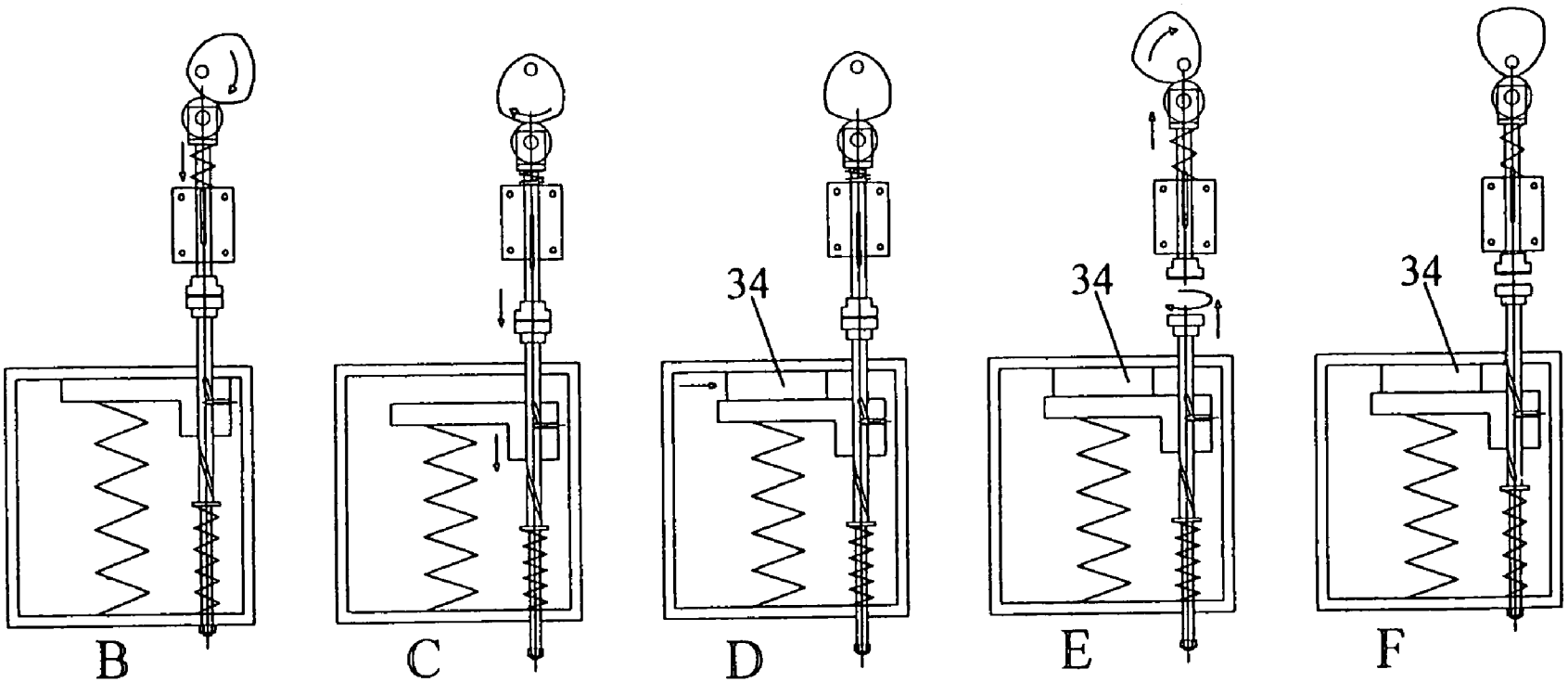
FIGS. 6A to 6F show successive stages of operation of a device for shifting a stack support of the embodiments of FIGS. 1 and 2 when a banknote is added to the stack.
Figure 7:
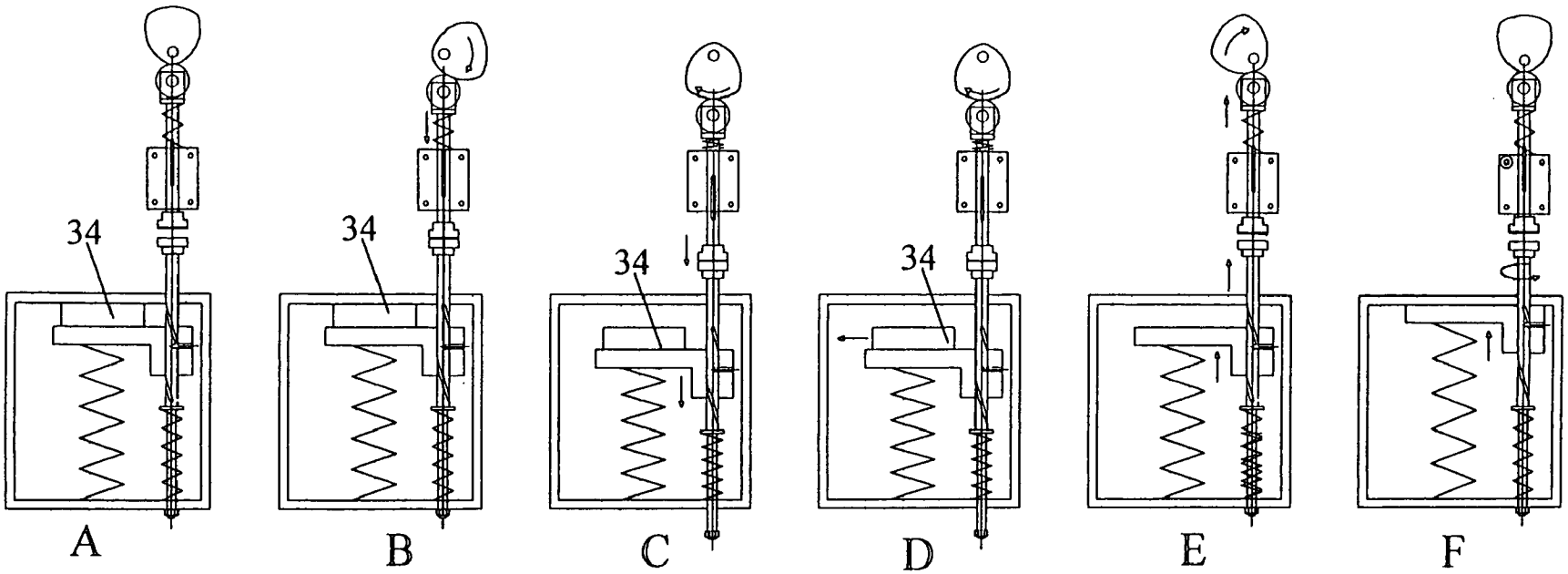
FIGS. 7A to 7F are views similar to those of FIGS. 6A to 6F but showing the stages of operation when a banknote is removed.

FIGS. 6 and 7 show the operation of the mechanism which ensures that the platform 6 is driven downwardly by a predetermined distance, irrespective of its initial position.

Figure 6A:
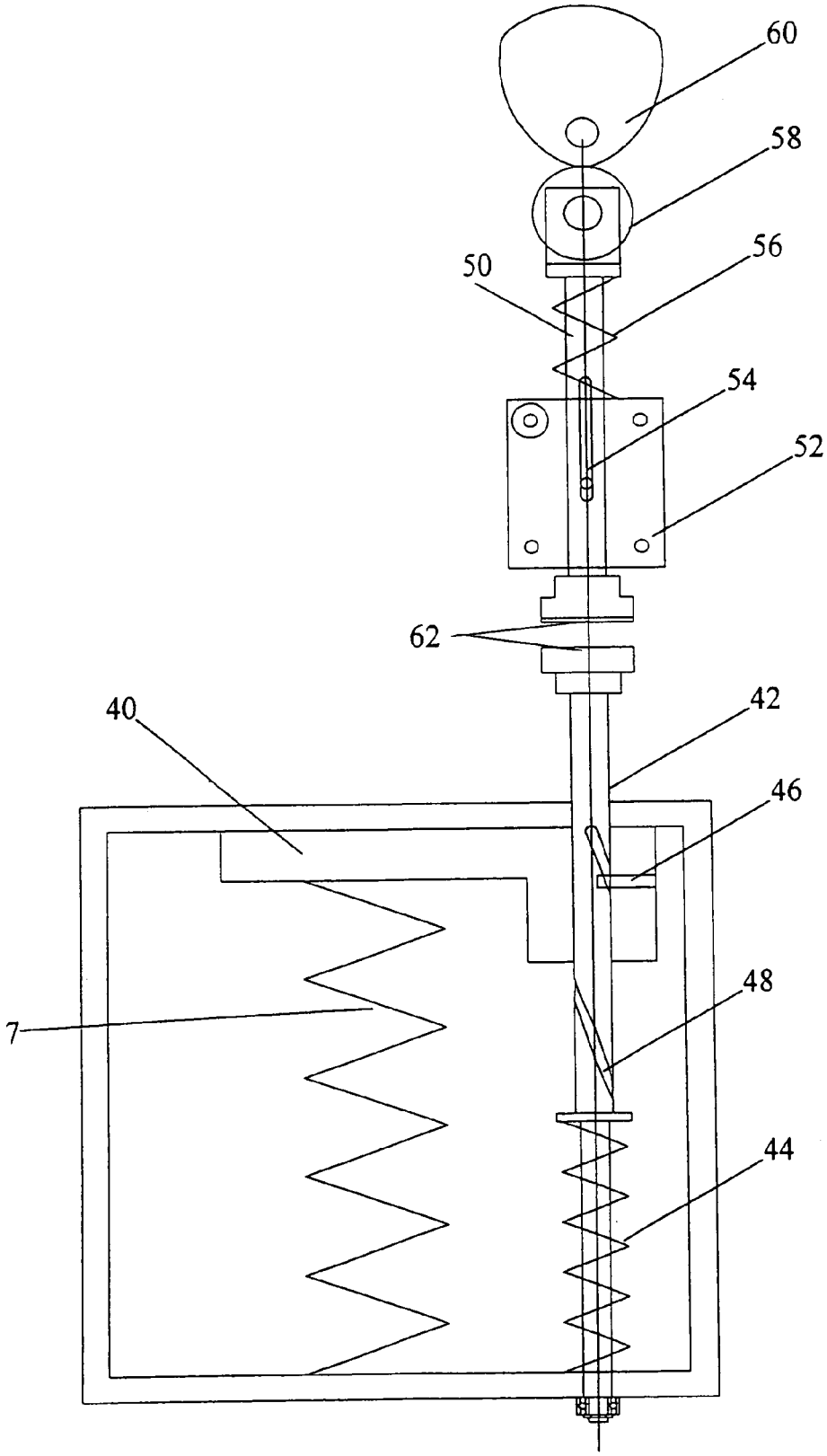

Referring to FIG. 6A, the mechanism comprises a member 40 attached to the platform 6 (not shown in FIG. 6). A lower shaft 42 extends downwardly through an aperture in the member 40, and is biassed upwardly by a spring 44. A pin 46 projects into a helical groove 48 in the surface of the shaft 42, the groove 48 and pin 46 thus operating as a worm gear.

An upper shaft 50 is located above the lower shaft 42 and supported in a collar 52. A vertical groove 54 in the shaft 50 co-operates with a pin (not shown) to ensure that the upper shaft 50 cannot rotate about its axis.

The shaft 50 is biassed upwardly by a spring 56, so that a roller 58 at the top of the shaft engages a cam 60.

The lower end of the upper shaft 50 faces the upper end of the lower shaft 42, these ends being provided with intra-engageable surfaces 62 having a high coefficient of friction.

To operate the mechanism, the cam 60 is rotated (FIG. 6B) to bring the surfaces 62 into engagement and then to push the shaft 42 downwardly (FIG. 6C). Because the upper shaft 50 cannot rotate, and because of the friction between the surfaces 62, the lower shaft 42 also cannot rotate and thus engagement of the groove 48 with the pin 46 causes the member 40 to move downwardly with the shaft 42.

Referring to FIG. 6D, assuming that a banknote 34 (the thickness of which is shown exaggerated for purpose of clarity) is added, then when the cam continues to rotate so that the spring 56 lifts the shaft 50 (FIG. 6E), the platform 6 and member 40 will not be able to rise very far. However, after the surfaces 62 disengage, the shaft 42 is free to rotate, and therefore can continue to rise to its initial position (FIG. 6F) as the pin 46 slides within the groove 48.

FIGS. 7A to 7F show similar operations which occur when the banknote 34 is removed. This means that by the time the shaft 42 moves back to its initial position (FIG. 7E), the member 40 and platform 6 have further to travel. However, as shown in FIG. 7F, this is permitted because the shaft 42 is free to rotate under the influence of the pin 46 moving upwardly and sliding in the groove 48.

Accordingly, the shaft 42 always returns to the same vertical position, irrespective of the thickness of the stack of banknotes. Thus, the stroke imparted to the shaft 42 is always the same, and because the shaft 42 cannot rotate when engaged by the upper shaft 50, the amount of movement imparted to the member 40 and thus the platform 6 is always the same.

FIGS. 8A to 8C show a third embodiment. In this embodiment, the fans 12 and 14 are supported on a piston 80 having a relative short stroke. Most of the time, the lower surface 82 of the piston 80 is located above the belt 8. However, when moving the platform 6 downwardly in order to extract a banknote, the piston 80 is also moved downwardly by a corresponding amount. The lower surface 82 is of smaller area than the banknotes and, preferably, disposed centrally of the banknote stack. Thus, with the fans 12, 14 in operation, the left and right ends of the banknote are pulled upwardly to a greater degree than the central region. The consequence is that the uppermost banknote is pulled into a non-planar configuration as shown in FIG. 8B. This reduces any tendency for a plurality of banknotes to be retained against the belt 8 by the fans 12, 14, rather than a single banknote.

The piston 80 is then moved upwardly (FIG. 8C) so that the uppermost banknote is held against the belt 8 before it is transported away.

Similar advantages can be achieved by providing a piston of variable geometry. Referring to FIGS. 9A to 9D, the piston 80 which supports the fans 12, 14 is normally located above the belt 8, but moved downwardly when the platform 6 is moved downwardly. The fans are energised at this time. Then, (FIG. 9C) the piston 80 is adjusted so that its two ends pivot upwardly, so that a lower surface 82 of the piston is non-planar, thus more positively separating the uppermost banknote from the rest of the stack. The piston 80 is then moved upwardly and straightened at the same time (FIG. 9D) before the uppermost banknote is removed.

Figure 9:
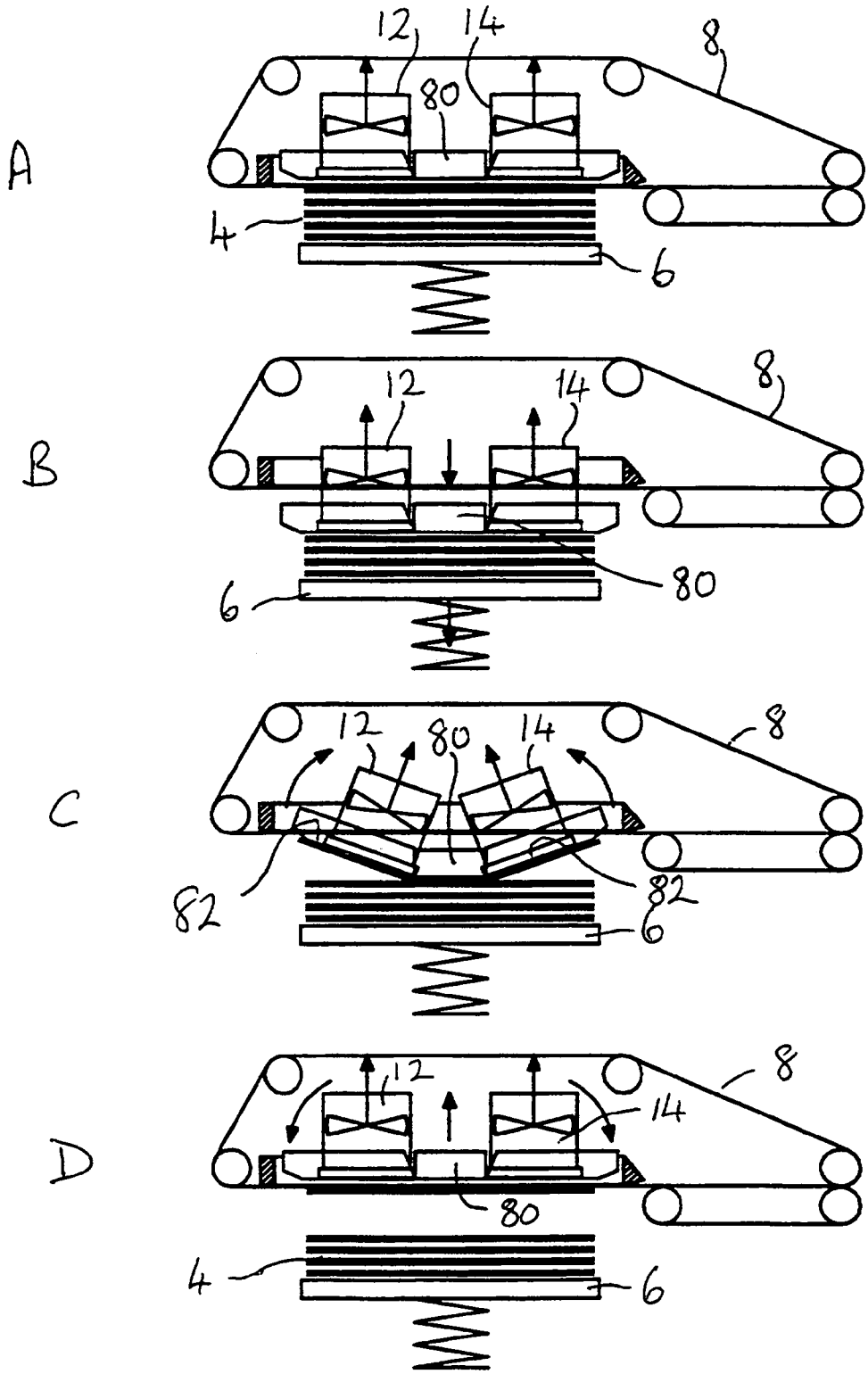
FIGS. 9A to 9D show a store according to a fourth embodiment of the invention.
Figure 10:
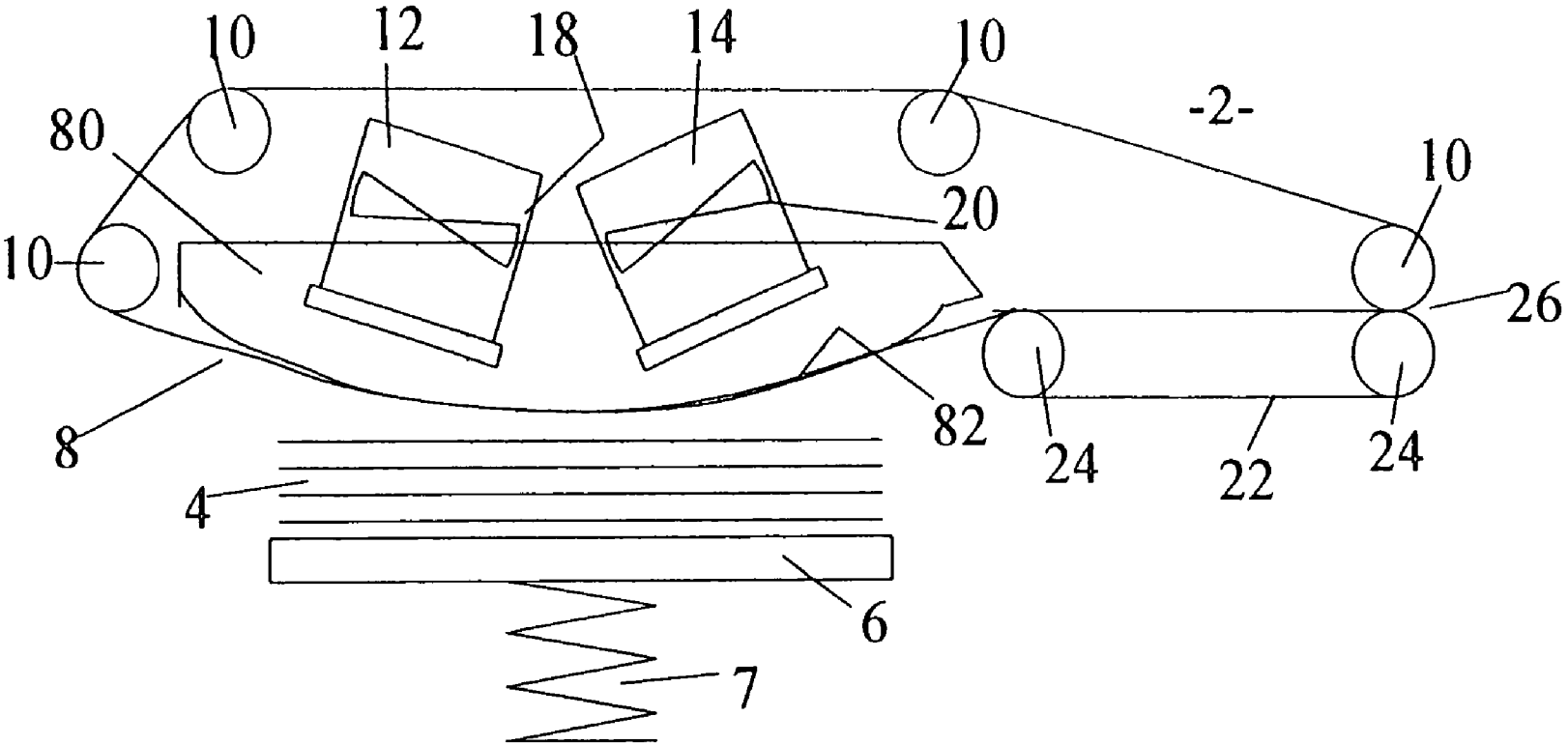
FIG. 10 shows part of a store according to a fifth embodiment of the invention.

FIG. 10 shows an alternative embodiment in which there is a static structure forming a non-planar surface 82. The belt 8 extends adjacent to this surface, and, when the fans 12, 14 are activated, the uppermost banknote will be pulled against the belt 8 and hence into a non-planar configuration. This arrangement therefore has similar advantages to those of FIGS. 8 and 9, but does not require a mechanism for shifting the fan-supporting structure 80 of those embodiments.

Figure 8:
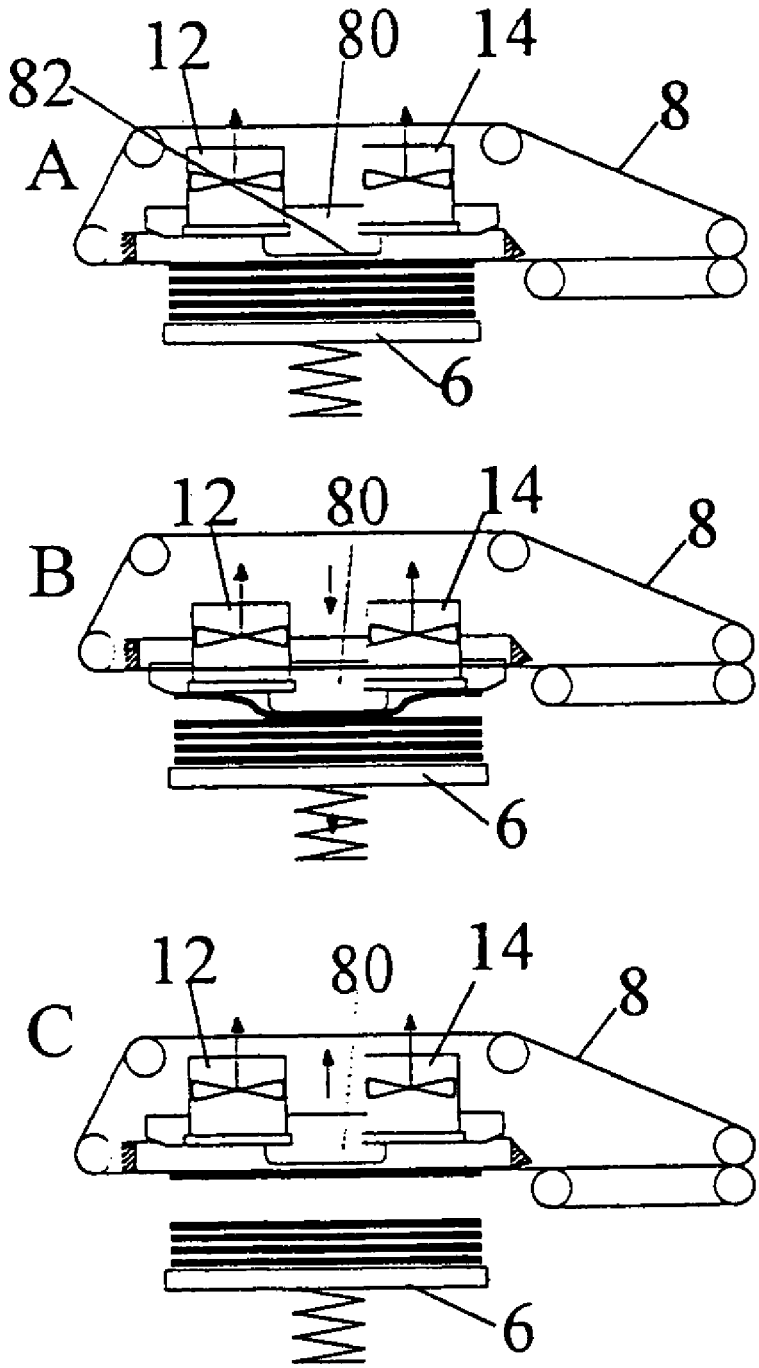
FIGS. 8A to 8C show a store according to a third embodiment of the invention.

Of course, the arrangements described with reference to FIGS. 8 to 10 can be applied to the escrow store of FIG. 2.

Various modifications can be made to the embodiments described above. For example, the fans 12, 14 may not be located in close proximity to the belt 8, but instead may be remote and connected to inlets near the belt 8 via conduits. The same fans may also be used for other stores, and valves or shutters may be used to control the application of the reduced pressure to the various parts of the stores. Additionally, or alternatively, instead of using a plurality of individually-energisable fans, there could be a single fan, preferably with means (such as a shutter) provided for progressively altering the area over which the reduced pressure is applied.

Figure 11:
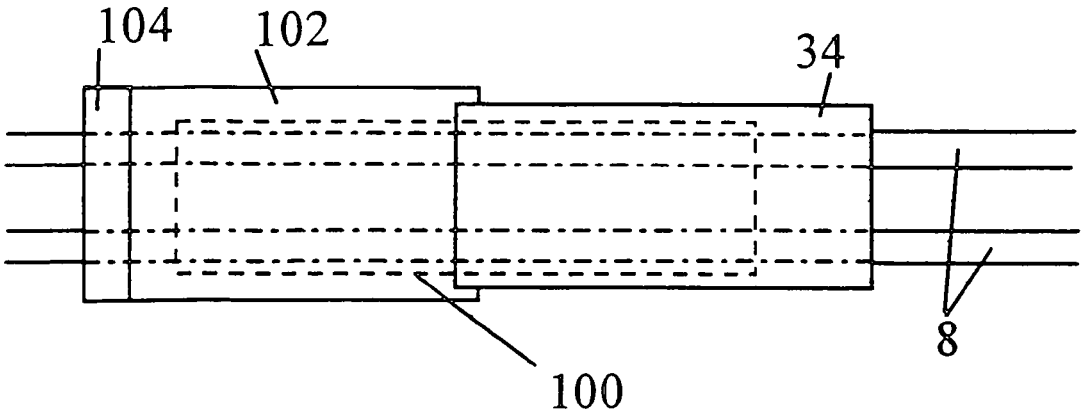
FIG. 11 is a view from below of the mouth of the air conveying means of a store according to a sixth embodiment of the invention.

For example, referring to FIG. 11, this shows a view from below of the mouth 100 of an air-conveying means coupled to a fan or other source of partial vacuum. As the banknote 34 is moved to the right by belts 8, a shutter 102 progressively closes the mouth 100. The shutter 102 could perhaps be unwound from a roll 104.

Figure 12:
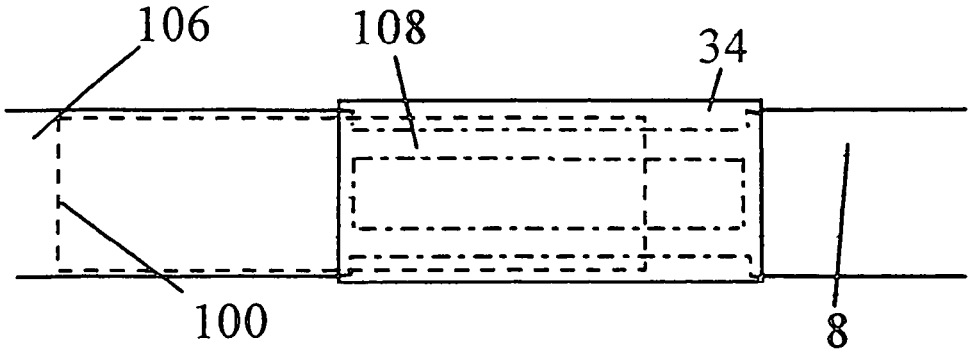
FIG. 12 is a view from below of the air conveying means of a seventh embodiment of the invention.

Alternatively, as shown in FIG. 12, the belt 8 may be formed of at least one portion 106 which blocks the air flow to the mouth 100 and thus acts as a shutter, and at least one portion 108 which allows air flow and thus permits a banknote 34 to be suspended against the belt.

Preferably, the maximum area (either a single continuous area or the total of a number of discrete areas) over which the reduced pressure is applied to the banknote is equal to at least 30 percent of the surface area of the banknote, and more preferably is greater than 75 percent of the area of the banknote, at least for some banknote denominations. It is to be noted that the store may be a multi-denominational store, or the same structure could be used for single denomination stores which handle respective different denominations.

In the embodiments described above, the light air pressure is applied to the banknote stack to attract the uppermost note before the platform and the supported stack are moved downwardly. Although this is the preferred operation, the reduction in pressure can occur after the platform is moved downwardly so as to lift the uppermost banknote, if this is desired.

Figure 13:
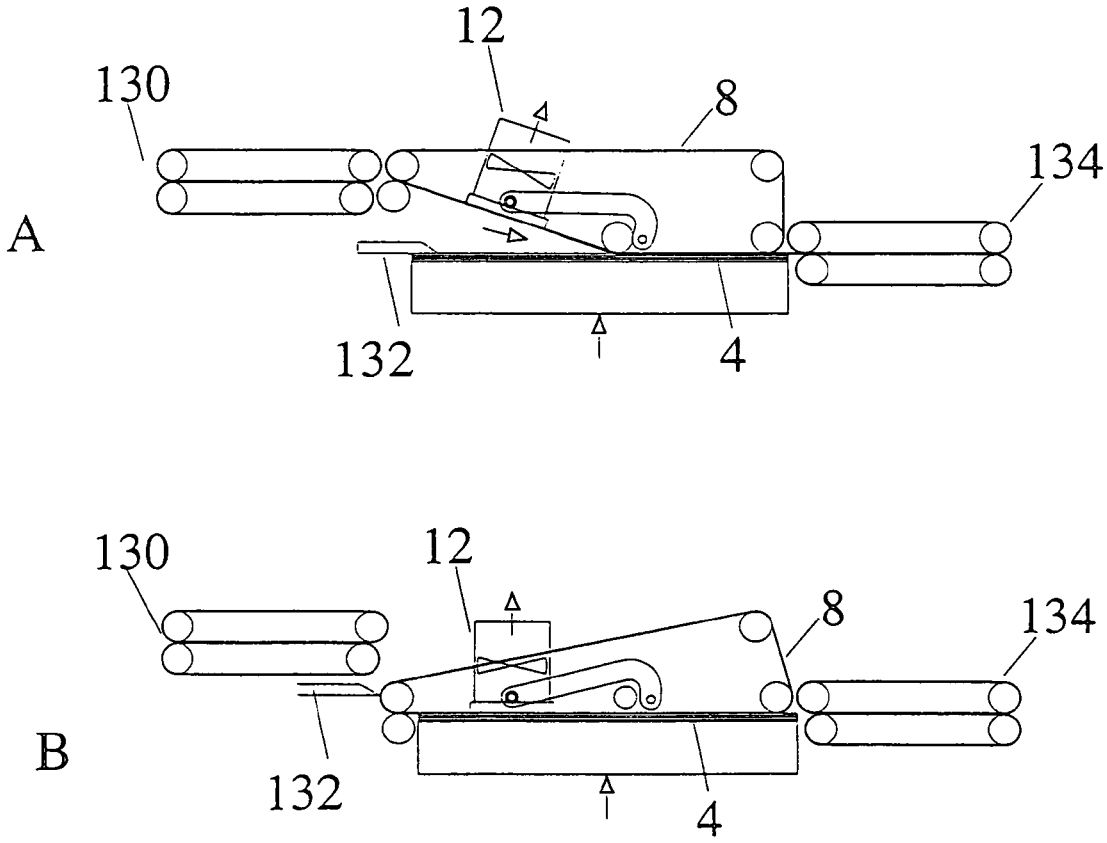
FIG. 13 illustrates an eighth embodiment of the invention.

In the embodiments described above, the platform supporting the stack is moved away from the transport means 8 during insertion or extraction of an individual banknote. Instead, the transport means 8, possibly in combination with the air conveying means, can be moved upwardly away from the stack. This could be achieved either by linear motion in an upward direction so that there is a gap between the stack and the belt 8 along the whole length of the stack. Alternatively, as shown in FIGS. 13A and 13B, the upper structure can be pivoted so that the belt is separated from the stack at one end of the stack, but remains in contact at the other end. The banknote is inserted by conveying it from an inlet conveyor 130 to the stack, using the belt 8, while the fan 12 is activated (FIG. 13A). Movement of the stack is prevented by clamping using a finger 132. The belt 8 is then brought down fully on top of the stack 4 (FIG. 13B) with the finger 132 removed. To remove a banknote, the fan 12 is activated and the belt pivoted back to the position shown in FIG. 13A with the finger 132 removed. The finger 132 is then reinserted to clamp the remainder of the stack, and the belt 8 is driven so that the uppermost note is fed to the exit conveyor 134.

What is claimed is:

1. A method of adding a banknote to a stack thereof, the method comprising moving the banknote laterally with respect to at least one fan so that the banknote moves through an airflow caused by the at least one fan to a position above the stack while the at least one fan applies reduced pressure over a substantial area of the banknote so as to hold it suspended above the stack, and then depositing the banknote on the top of the stack by deactivating the at least one fan.

2. A method of adding a banknote to a stack thereof, the method comprising moving the banknote laterally with respect to at least one fan so that the banknote moves through an airflow caused by the fan to a position above the stack while the fan applies reduced pressure over a region of the banknote that is at least thirty percent of a surface of the banknote so as to hold it suspended above the stack, and then depositing the banknote on the top of the stack by deactivating the fan.

3. A method as claimed in claim 1 or 2, including the step of progressively increasing the area over which the reduced air pressure is applied as the banknote is laterally moved beneath the at least one fan.

4. A method of handling banknotes, the method comprising adding a banknote to a stack using a method as claimed in claim 3, and removing a banknote from the stack causing said at least one fan to reduce the air pressure above the top banknote so as to separate the top banknote from the others, and moving the separated banknote laterally relative to the at least one fan.

5. A method as claimed in claim 4, including the step of progressively reducing the area over which the air pressure is reduced as the banknote is moved laterally when being removed from the stack.

6. A method as claimed in claim 4, wherein the reduced air pressure retains the banknote against a non-planar structure when the banknote is removed from the stack.

7. Apparatus for storing banknotes in a stack, the apparatus having at least one fan to cause a reduced air pressure to be applied over a substantial area of a banknote; and means for transporting a banknote relative to the at least one fan; whereby a banknote can be separated from the top of the stack using the reduced air pressure, and then moved laterally using the transporting means, and whereby a banknote can be added to the stack by using the transporting means to move the banknote to a position where it is suspended above the stack by the at least one fan, and then depositing the banknote on the stack, the apparatus including support means for supporting the banknote stack, the support means being arranged for biasing the stack towards the transporting means.

8. Apparatus for storing banknotes in a stack, the apparatus having at least one fan to cause a reduced air pressure to be applied over a region of a banknote that is at least thirty percent of a surface of the banknote; and means for transporting a banknote relative to the fan; whereby a banknote can be separated from the top of the stack using the reduced air pressure, and then moved laterally using the transporting means, and whereby a banknote can be added to the stack by using the transporting means to move the banknote to a position where it is suspended above the stack by the fan, and then depositing the banknote on the stack, the apparatus including support means for supporting the banknote stack, the support means being arranged for biasing the stack towards the transporting means.

9. Apparatus as claimed in claim 7 or 8, including means for moving the support means away from the transporting means prior to extracting a banknote from or adding a banknote to the store.

10. Apparatus as claimed in claim 9, wherein the means for moving the support means is arranged to move the support means through a predetermined distance irrespective of its initial position.

11. Apparatus as claimed in claim 7 or claim 8, including additional transport means carried by the support means, to enable the entire stack to be removed from the storage apparatus as a bundle.

12. Apparatus for storing banknotes in a stack, the apparatus having air conveying means to cause a reduced air pressure to be applied over a substantial area of a banknote; and means for transporting a banknote relative to the air conveying means; whereby a banknote can be separated from the top of the stack using the reduced air pressure, and then moved laterally using the transporting means, and whereby a banknote can be added to the stack by using the transporting means to move the banknote to a position where it is suspended above the stack by the air conveying means, and then depositing the banknote on the stack, the apparatus including at least one fan for causing a reduced air pressure in a conduit forming said air conveying means.

13. Apparatus for storing banknotes in a stack, the apparatus having air conveying means to cause a reduced air pressure to be applied a region of a banknote that is at least thirty percent of a surface of the banknote; and means for transporting a banknote relative to the air conveying means; whereby a banknote can be separated from the top of the stack using the reduced air pressure, and then moved laterally using the transporting means, and whereby a banknote can be added to the stack by using the transporting means to move the banknote to a position where it is suspended above the stack by the air conveying means, and then depositing the banknote on the stack, the apparatus including at least one fan for causing a reduced air pressure in a conduit forming said air conveying means.

14. Apparatus as claimed in claim 12 or claim 13, including a plurality of fans for producing the reduced air pressure, and further including control means for causing at least one of (i) switching the fans off in a progressive manner as a banknote is removed from the store, and (ii) switching the fans on in a progressive manner as a banknote is added to the store.

* * * * *